US012298065B2

(12) United States Patent
Boehringer et al.

(10) Patent No.: US 12,298,065 B2
(45) Date of Patent: May 13, 2025

(54) REFRIGERATOR AND CORRESPONDING VALVE SYSTEM

(71) Applicant: WHIRLPOOL CORPORATION, Benton Harbor, MI (US)

(72) Inventors: Bruno Boehringer, Cypress, TX (US); Chao-Yi Chen, Saint Joseph, MI (US); Pravan Karan, Stevensville, MI (US); Abhay Naik, Stevensville, MI (US); Antonio Sanchez, Stevensville, MI (US); Mrunal Shaldar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 140 days.

(21) Appl. No.: 18/311,410

(22) Filed: May 3, 2023

(65) Prior Publication Data

US 2024/0369288 A1 Nov. 7, 2024

(51) Int. Cl.
*F25D 23/06* (2006.01)

(52) U.S. Cl.
CPC ..... *F25D 23/067* (2013.01)

(58) Field of Classification Search
CPC ..... F25D 23/067; F25D 23/126; F25D 2331/806; F25C 2400/10; F25C 2400/14
See application file for complete search history.

(56) References Cited

U.S. PATENT DOCUMENTS

| | | | |
|---|---|---|---|
| 2012/0111049 A1 | 5/2012 | Kim et al. | |
| 2022/0034581 A1 | 2/2022 | You | |
| 2022/0228799 A1 | 7/2022 | Giacomini et al. | |
| 2022/0282898 A1* | 9/2022 | Pagnozzi | F25C 1/25 |

FOREIGN PATENT DOCUMENTS

| | | | | |
|---|---|---|---|---|
| CN | 101084405 A | * | 12/2007 | B01D 5/0039 |

* cited by examiner

*Primary Examiner* — Emmanuel E Duke
(74) *Attorney, Agent, or Firm* — Brooks Kushman P.C.

(57) ABSTRACT

A water valve system for a refrigerator appliance includes a bracket and a first set of one or more valves. The bracket is configured secure one or more valves to the refrigerator. The bracket has locating and fastening features configured to locate and secure the one or more valves on and to the bracket in a plurality of configurations. The first set of the one or more valves is arranged in a first of the plurality of configurations and engages at least a portion of the locating and fastening features to locate and secure the first set of the one or more valves on and to the bracket.

20 Claims, 12 Drawing Sheets

REFRIGERATOR AND CORRESPONDING VALVE SYSTEM

TECHNICAL FIELD

The present disclosure relates to an appliance such as a refrigerator.

BACKGROUND

Refrigerator appliances may include systems that require a water supply. Such systems may be configured to produce ice cubes or to deliver water to a user via a dispensing device.

SUMMARY

A refrigerator includes a cabinet, a valve system, and a false wall. The cabinet has a plurality of internal walls defining a refrigerated space. The valve system has a bracket and a first of a plurality of valve configurations. The bracket is secured to a first of the internal walls. The bracket has locating and fastening features configured to locate and secure a plurality of valve configurations on and to the bracket. The first of the plurality of valve configurations engages at least a portion of the locating and fastening features to locate and secure the first of the plurality of valve configurations on and to the bracket. The false wall is disposed within the refrigerated space and over the valve system such that the valve system is concealed within the refrigerated space and is disposed between the first of the internal walls and the false wall.

A water valve system for a refrigerator appliance includes a bracket and a first set of one or more valves. The bracket is configured secure one or more valves to the refrigerator. The bracket has locating and fastening features configured to locate and secure the one or more valves on and to the bracket in a plurality of configurations. The first set of the one or more valves is arranged in a first of the plurality of configurations and engages at least a portion of the locating and fastening features to locate and secure the first set of the one or more valves on and to the bracket.

A bracket that is configured to secure one or more valves to a refrigerator includes a base plate, locating and fastening features, a first protruding region, and a second protruding region. The locating and fastening features protrude from a forward-facing surface of the bracket. The locating and fastening features are configured to locate and secure valves on and to the bracket in a plurality of configurations. The first and second protruding regions extending outward from the forward-facing surface. The first and second protruding regions define first and second notches, respectively, having open ends facing a common direction. The first and second protruding regions are offset relative to each other in a direction that is transverse to the common direction. The first and second protruding regions are configured to engage locators on the refrigerator to position the bracket in a desired orientation relative to the refrigerator and to prevent the bracket from being positioned in orientations other than the desired orientation relative to the refrigerator.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
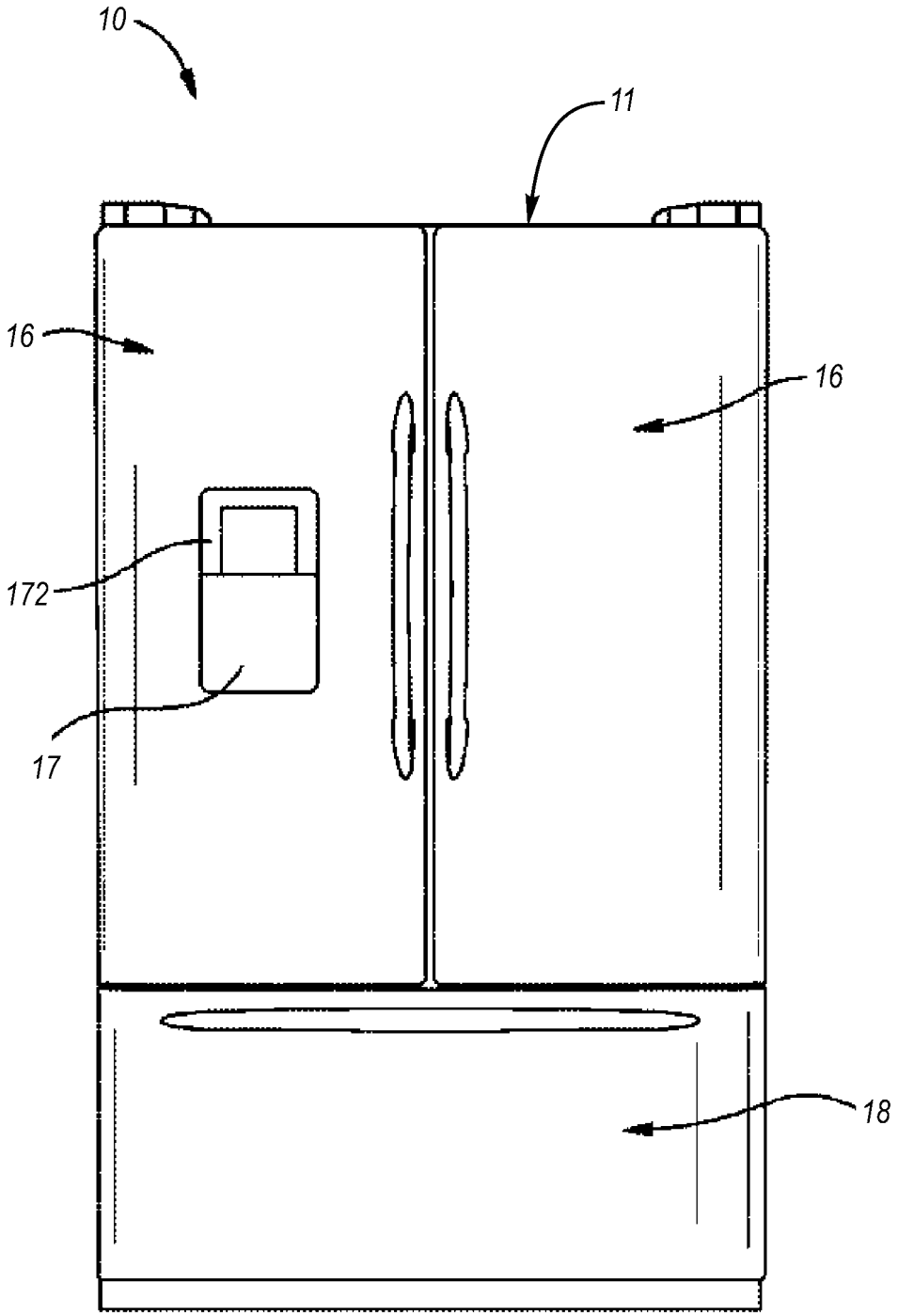
FIG. 1 is an elevated front view of a French-Door Bottom Mount type refrigerator appliance.

Referring to FIG. 1, reference numeral 10 generally designates a refrigerator with an automatic ice maker 20. As described below, an automatic ice maker is an ice maker either as a stand-alone appliance, or within another appliance such as a refrigerator, wherein the ice making process is typically induced, carried out, stopped, and the ice is harvested with substantially no user input.

Figure 2A:
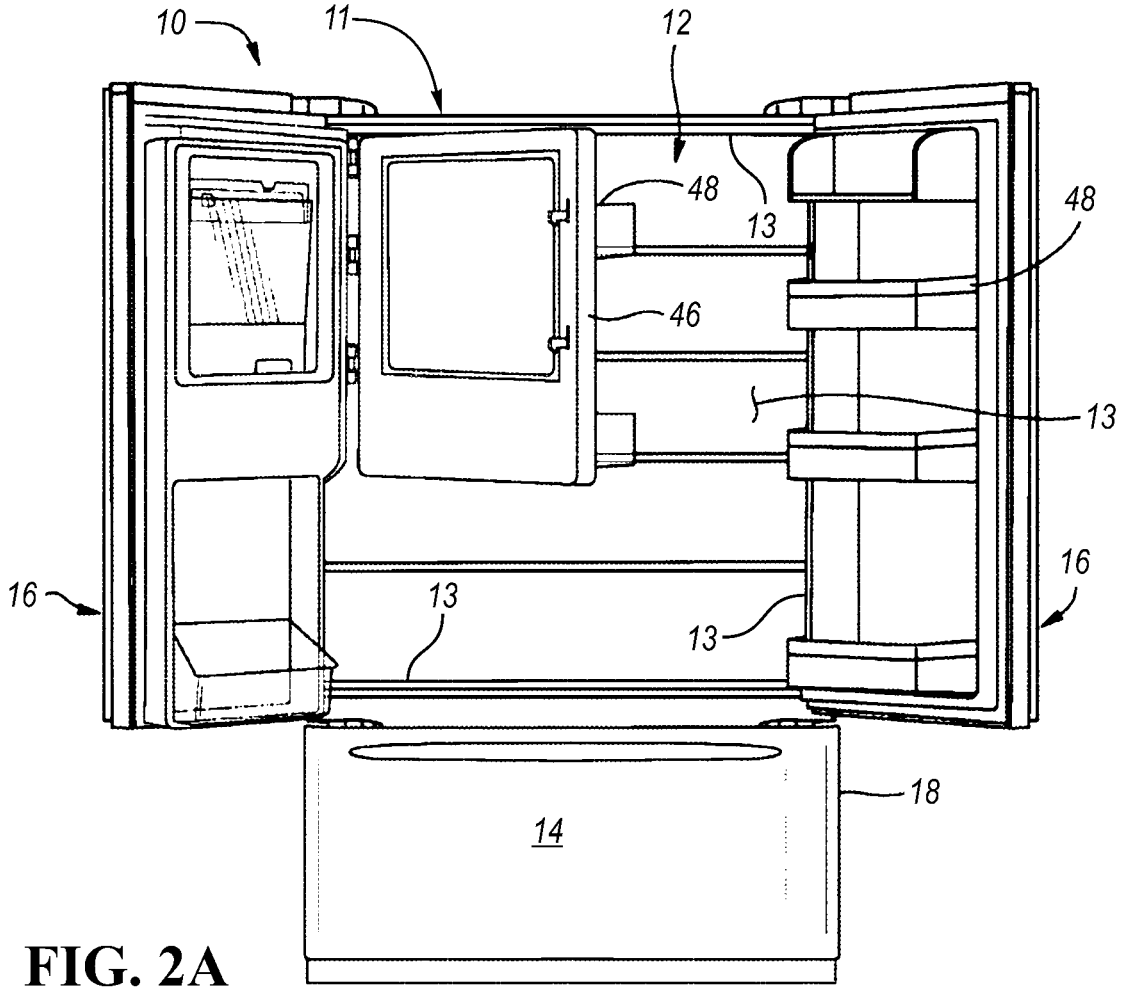
FIG. 2A is an elevated front view of a French-Door Bottom Mount type refrigerator with the refrigerator compartment doors open.
Figure 2B:
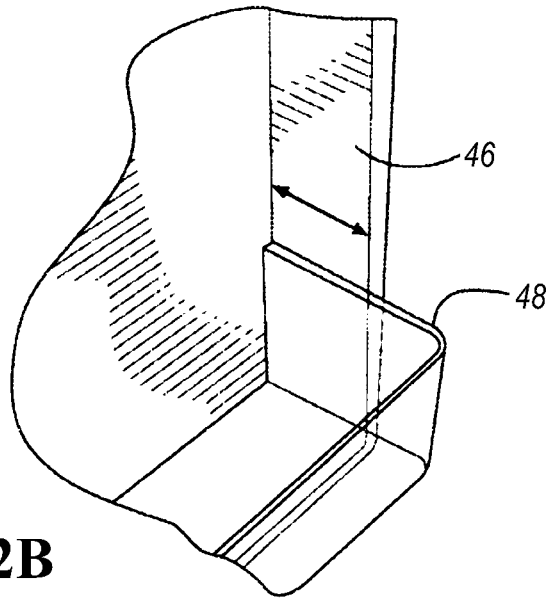
FIG. 2B is a perspective view of an aspect of an access door for the ice maker.

FIG. 1 generally shows a refrigerator 10 of the French-Door Bottom Mount type, but it is understood that this disclosure could apply to any type of refrigerator, such as a side-by-side, two-door bottom mount, or a top-mount type. As shown in FIGS. 1-2B, the refrigerator 10 may have a housing or cabinet 11 defining a first refrigerated space, a first internal storage chamber, first internal cavity, or fresh food compartment 12 configured to refrigerate and not freeze consumables or foodstuffs within the fresh food compartment 12. The cabinet 11 may also define a second refrigerated space, a second internal storage chamber, second internal cavity, or a freezer compartment 14 configured to freeze consumables or foodstuffs within the freezer compartment 14 during normal use. The cabinet 11 includes walls 13 that define the fresh food compartment 12 and the freezer compartment 14. The walls 13 may include both exterior panels and interior panels. The interior panels may form an inner liner. An insulating material, such as an insulating foam, may be disposed between the exterior panels and the interior panels. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16.

Figure 3:
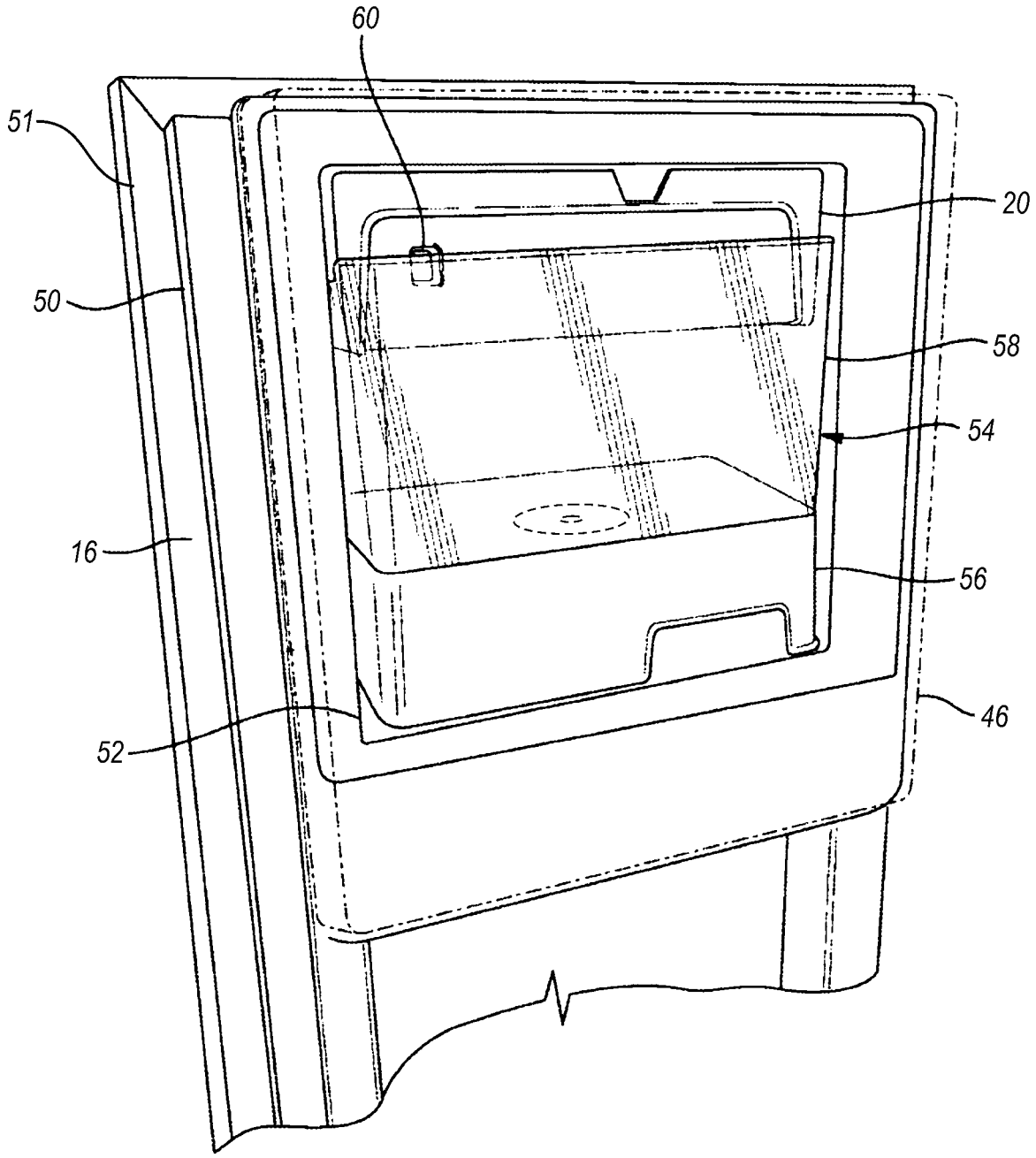
FIG. 3 is a perspective view of the interior of one door of the refrigerator compartment with the ice maker and ice container installed.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F. As shown in FIGS. 2A-3, an ice maker 20 may be located on a door 16 to the refrigerated fresh food compartment 12. The ice maker 20 may defined as an assembly of a bracket, a motor, an ice tray, a bail arm connected to the motor 24, at least one wire harness and at least one thermistor. The door 16 may include ice maker 20 and ice bin access door 46 hingedly connected to one of the doors 16 for the refrigerator 10 along the side proximate the hinge for the door 16 of the refrigerator 10 carrying the ice maker 20, i.e. the vertical edge closest to the cabinet. The hinge may be a single or multiple hinge(s) and may be spaced along the entire edge, substantially the entire edge, or more frequently two hinges may be used with one close to the top edge of the access door 46 and one close to the bottom edge of the access door 46.

Significantly, due at least in part to the access door 46 and the design and size of the ice maker 20, the access door 46 has a peripheral edge liner that extends outward from the surface of the access door 46 and defines a dike wall. The dike walls extend from at least the two vertical sides, more typically all four sides and define a door bin receiving volume along the surface of the access door 46. The access door 46 is selectively operable between an open position, in which the ice maker 20 and the ice storage container or bin 54 are accessible, and a closed position, in which the ice maker 20 and the ice storage bin 54 are not accessible. The access door 46 may also include door bins 48 that are able to hold smaller food items. The door bins 48 may also be located on or removably mounted to the access door 46 and at least partially spaced within the door bin receiving volume of the access door 46. While not typically the case, the ice maker 20 may also be located exterior the fresh food compartment 12, such as on top of the refrigerator cabinet, in a mullion between the fresh food compartment 12 and the freezer compartment 14, in a mullion between two fresh food compartments 12, or anywhere else an automatic, motor driven ice maker 20 may be located.

The refrigerator 10 may also have a duct or duct system (not shown) with an inlet in the freezer compartment 14 and an outlet in the fresh food compartment 12. The duct may be situated such that the length of the duct necessary to direct air from the freezer compartment 14 to the fresh food compartment 12 is minimized, reducing the amount of heat gained in the travel between the inlet and the outlet. The duct outlet located in fresh food compartment 12 may be positioned at a location near the ice maker 20. The refrigerator 10 may also have one or more fans, but typically has a single fan (not shown) located in the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20 to freeze into ice cubes. In the embodiment shown, the ice maker 20 is located in the fresh food compartment 12, which typically holds air above the freezing point of water.

In various embodiments, where the ice maker 20 is located in a compartment or location other than in the freezer compartment 12, a fan is needed to force the air to the ice maker 20. In other embodiments, the fan or fans may be located either in the freezer compartment 14, the fresh food compartment 12, or in another location where the fan is able force air through the duct. The ice maker 20 is often positioned within a door of the refrigerator 10 to allow for delivery of ice through the door 16 in a dispensing area 17 on the exterior of the refrigerator 10, typically at a location on the exterior below the level of the ice storage bin 54 to allow gravity to force the ice down an ice dispensing chute into the refrigerator door 16. The chute extends from the bin to the dispensing area 17 and ice is typically pushed into the chute using an electrical power-driven auger. Ice is dispensed from the ice storage bin 54 to the user of the refrigerator 10.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

FIG. 3 shows a closer view of a door 16 with the access door 46 in hidden lines to show the ice maker 20. The door 16 may have an inner liner 50 that is secured to an outer panel 51. The door liner 50 is disposed on an internal side of the outer panel 51 and defines an ice maker receiving space 52 in which the ice maker 20 and an ice storage bin 54 of the ice maker assembly are disposed. The ice maker receiving space 52 may be referred to a cavity or receptacle that is defined by the inner liner 50 and is configured to receive the ice storage bin 54. The ice storage bin 54 may be removably positioned within the ice maker receiving space 52 (i.e., the ice storage bin 54 may be inserted into or removed from the ice maker receiving space 52). The ice maker 20 may be located at an upper portion of the ice maker receiving space 52. The ice bin 54 may be located below the ice maker 20 such that as ice is harvested, the ice maker 20 uses gravity to transfer the ice from the ice maker 20 to the ice storage bin 54. The ice storage bin 54 may comprise an ice bin base 56 and one or more ice bin walls 58 that extends upwardly from the perimeter of the ice bin base 56.

The ice maker 20 may include an on/off switch 60. The on/off switch 60 may be located on the ice maker 20 in a location that is accessible to a user without removing the ice maker 20 from the door 16 or the refrigerator 10. The ice bin wall 58 may be configured such that when the ice storage bin 54 is placed in the door 16, the on/off switch 60 is inaccessible to the user, and when the ice storage bin 54 is removed from the door 16, the on/off switch 60 is accessible to a user. The ice storage bin wall 58 may be made of a clear plastic material such as a copolyester so that a user can see the on/off switch 60 even while inaccessible when the ice bin 54 is in place. However, the front portion of the ice bin wall 58 typically extends to cover the on/off switch 60 when in the installed position to prevent inadvertent actuation of the on/off switch 60. The front portion of the ice bin wall 58 also typically extends upward to form a lip that extends around at least a portion of the ice maker 20 to further retain ice.

The ice maker 20, the door 16 (or more specifically, the portions of the door 16 that define the ice maker receiving space 52), and the ice storage bin 54 may collectively be referred to as an ice maker assembly. The door 16 (or more specifically, the portions of the door 16 that define the ice maker receiving space 52) and the ice storage bin 54 may collectively be referred to as an ice bin assembly.

Figure 4:
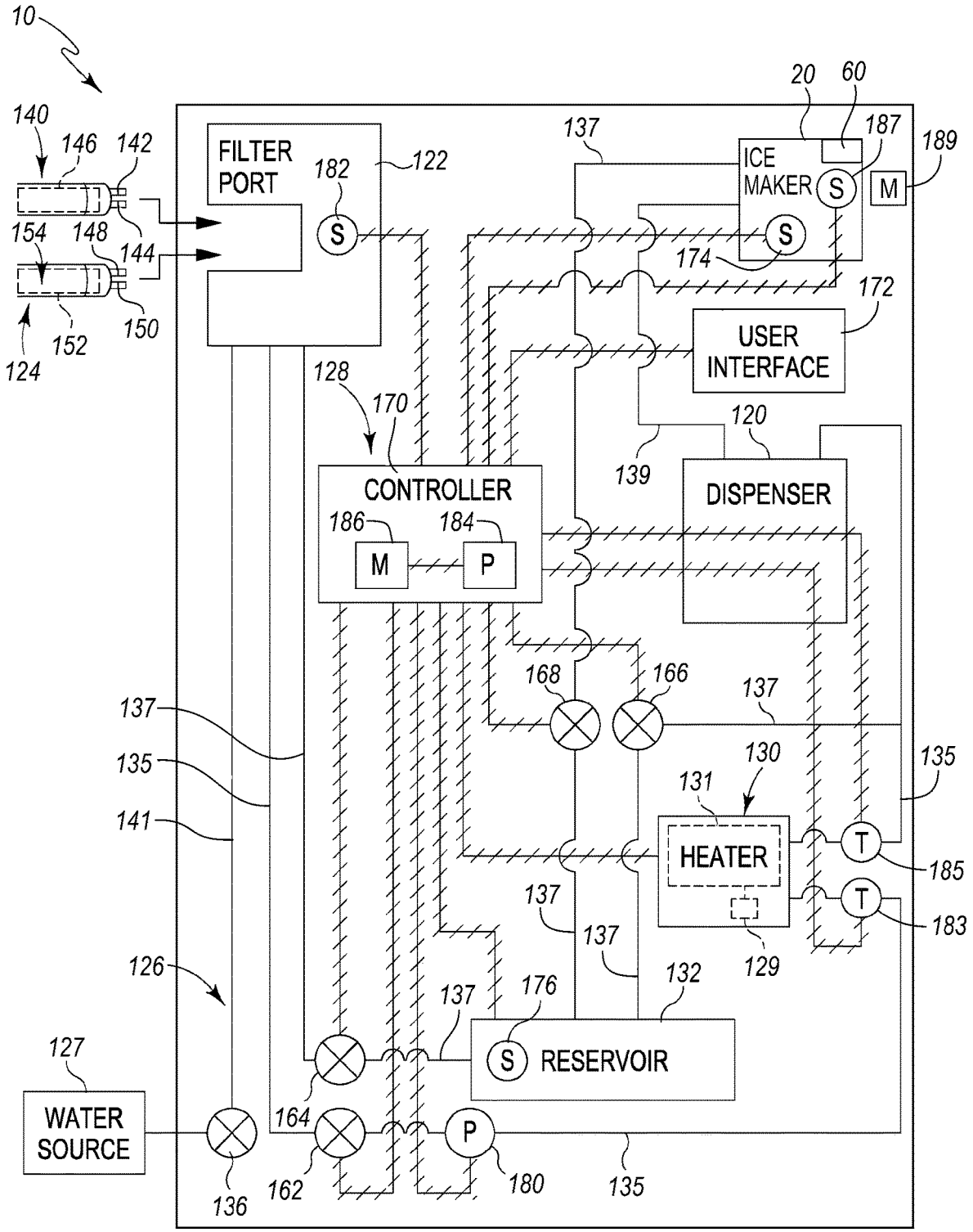
FIG. 4 is a diagrammatic view of the refrigerator appliance.

Referring now to FIG. 4, the refrigerator 10 includes a water system 126 and a control system 128 for controlling the water system 126. The water system 126 delivers or directs water from a water source 127 to the dispenser 120 which may be located in dispensing area 17. The water system 126 also delivers or directs water from the water source 127 to the ice maker 20. The control system 128 may be operable to control the various components of the water system 126 so that the dispenser 120 dispenses cold water, hot water, or ice. The control system 128 is also operable to control the water system 126 during a pre-programmed descaling cycle or other pre-programmed cycle.

The water system 126 includes a number of components for conditioning water to be discharged through the dispenser 120. In particular, the water system may have a heating assembly 130, a cold water reservoir 132, and include ice maker 20. The heating assembly 130 includes a flow-through heating element 131 and a thermal fuse 129 configured to cut power to the flow-through heating element 131 when the flow-through heating element 131 reaches a predetermined temperature. The heating assembly 130 may be positioned between the water filter port 122 and the dispenser 120 along a hot water line 135. The cold water reservoir 132 accumulates and cools water in the refrigerator 10 prior to the water being discharged through the dispenser 120 or supplied to the ice maker 20. The cold water reservoir 132 is positioned between the water filter port 122 and the dispenser 120 along a cold water line 137. The ice maker 20 receives cold water from the cold water reservoir 132 and generates ice that is discharged through the dispenser 120 via an ice line 139.

One exemplary flow-through heating element 131 is a Ferro Flow Through Heater (FTH). The flow-through heating element 131 may positioned in the refrigerator door 16 below the dispenser 120 and outside a refrigerator insulation layer. The flow-through heating element 131 is illustratively oriented in a flat orientation so that water flows in a substantially horizontal direction through the flow-through heating element 131. In some embodiments, the flow-through heating element 131 may be a thermoblock element, a microwave element, or another suitable type of heating element. Additionally, the heating element may be positioned in another location in the door 16 or the refrigerator 10 and may be placed in a number of orientations relative thereto. In alternative embodiments of the present disclosure, the flow-through heating element 131 may be replaced or augmented by a batch heating system including a heating element and a hot water reservoir.

All the water (liquid or ice) dispensed by the refrigerator 10 may pass through the water filter port 122. The water system 126 may include a main valve 136 coupled to the water source 127 and the water filter port 122 may be coupled to the main valve 136 via a water inlet line 141. The hot water line 135 and the cold water line 137 may extend from the water filter port 122 directing water through the rest of the water system 126. The main valve 136 may be manually opened or closed to selectively allow water from the water source 127 to enter the water system 126 of the refrigerator 10.

The water filter port 122 may be configured to receive a water filter cartridge 140 or a descaling cartridge 124. The water filter cartridge 140 is illustratively consumable and discarded after use. The water filter cartridge 140 includes an inlet 142, an outlet 144, and a filter media 146 as is known in the art. In other embodiments, the water filter cartridge 140, or portions thereof, may be reusable. The descaling cartridge 124 is illustratively consumable and is charged to supply enough descaling agent 154 for one descaling cycle. In other embodiments, the descaling cartridge 124 may be refillable and/or reusable.

The descaling cartridge 124 may include an inlet 148, an outlet 150, and a descaling packet 152 containing descaling agent 154. The inlet 148 may be open to the water lines of the refrigerator 10. The descaling packet 152 may be coupled to the outlet 150 and may be squeezed by water flowing into the descaling cartridge 124 so that the descaling agent 154 is dispensed through the outlet 150 into the water lines. Water ceases to flow into the descaling cartridge 124 when the descaling cartridge 124 is full of water and the descaling packet 152 is emptied. The descaling agent 154 may then be advanced through the water system 126 and reacts with the scale built up in the water system 126 so that the scale can be flushed out of the water system 126 when the reacted descaling agent 154 is discharged through the dispenser 120. In the illustrative embodiment, the descaling agent 154 is a solution with about an 8 percent concentration of acetic acid. In other embodiments, other organic acids including but not limited to sulfonic acids or carboxylic acids, in particular, lactic acid, acetic acid, formic acid, oxalic acid, uric acid solutions may be used alone or mixtures thereof. It is also possible to use inorganic acids such as phosphoric acid, hydrochloric acid or sulfamic acid solutions. Mixtures of various inorganic and organic acids could also conceivably be used as descaling agents in accordance with embodiments of the present invention.

In other embodiments, the inlet 148 and the outlet 150 may both be open to the water lines of the refrigerator 10. In such embodiments, the descaling packet 152 may be open inside the descaling cartridge 124 or opened when water enters the descaling cartridge 124 so that water flowing through the descaling cartridge is mixed with descaling agent. The water mixing with the descaling agent 154 dilutes and carries the descaling agent through the water lines of the refrigerator 10. In some such embodiments, the descaling agent 154 may be a liquid descaling agent or a solid agent.

The water system 126 further includes a number of electronically controlled valves that can be operated to supply hot or cold water to the dispenser 120 or to supply cold water to the ice maker 20. Specifically, the water system may include a hot water valve 162, a cold water valve 164, a cold water dispenser valve 166, and an ice maker valve 168. The hot water valve 162 may be coupled between the water filter port 122 and the dispenser 120 along the hot water line 135. The cold water valve 164 may be coupled between the water filter port 122 and the dispenser 120 along the cold water line 137. The cold water dispenser valve 166 may be coupled between the cold water reservoir 132 and the dispenser 120 along the cold water line 137. The ice maker valve 168 may be coupled between the cold water reservoir 132 and the ice maker 20 along the cold water line 137.

In operation, the hot water valve 162 can be opened to advance water from the water source 127 through the heating assembly 130 to the dispenser 120. The cold water valve 164 can be opened to advance water from the water source 127 to the cold water reservoir 132. The cold water dispenser valve 166 can be opened to advance cold water from the cold water reservoir 132 to the dispenser 120. The ice maker valve 168 can be opened to advance water from the cold water reservoir 132 to the ice maker 20. Otherwise, each of the valves 162, 164, 166, 168 may be biased closed to prevent water from being advanced through the water system 126.

The control system 128 of the refrigerator 10 illustratively includes a controller 170, a user interface 172, and a number of sensors 174, 176, 180, 182, 183, 185, 187. The controller 170 is configured to operate the components of the water system 126 in response to inputs from the user interface 172 and the sensors 174, 176, 180, 182, 183, 185, 187. The user interface 172 is configured to display information and to receive user inputs. The sensors 174, 176, 180, 182, 183, 185, 187 detect information and communicate information to the controller 170.

The controller 170 includes a number of electronic components commonly associated with electronic units which are utilized in the control of electromechanical systems. For example, the controller 170 may include, amongst other components customarily included in such devices, a processor such as a microprocessor 184 and a memory device 186 such as a programmable read-only memory device ("PROM") including erasable PROM's (EPROM's or EEPROM's). The memory device 186 is provided to store, amongst other things, instructions in the form of, for example, a software routine (or routines) which, when executed by the processor, allows the controller 170 to control operation of the water system 126 and other systems included in the refrigerator 10.

While illustrated as one controller, the controller 170 may be part of a larger control system and may be controlled by various other controllers throughout the refrigerator 10. It should therefore be understood that the controller 170 and one or more other controllers can collectively be referred to as a "controller" that controls various actuators in response to signals from various sensors to control functions the refrigerator 10. The controller 170 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMS (electrically PROM), EEPROMs (electrically erasable PROM), flash memory, or any other electric, magnetic, optical, or combination memory devices capable of storing data, some of which represent executable instructions, used by the controller 170 in controlling the refrigerator 10.

Control logic or functions performed by the controller 170 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for case of illustration and description. The control logic may be implemented primarily in software executed by a microprocessor-based controller, such as controller 170. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

The user interface 172 is illustratively coupled to the controller 170 for two way communication via a signal line as shown in FIG. 4. User interface 172 may include control buttons, paddles, and indicator lights. The buttons may be pressed to receive user inputs requesting that water dispensed be cold or hot, that ice dispensed be cubed or crushed, or that pre-programmed cycles (such as the descaling cycle) be performed by the refrigerator 10. The paddles may be pressed so that the controller 170 receives inputs requesting that water or ice be discharged by the dispenser 120. The indicator lights may be used to indicate the temperature of water to be dispensed, the type of ice to be dispensed, the status of the water filter cartridge 140, the need for a descaling cycle, the availability of one or more functions of the refrigerator 10, or other information. In some embodiments, the user interface 172 may include a graphic display, a touch screen, or other interface operable to display information and to receive user inputs.

The controller 170 is electrically coupled to each of the sensors 174, 176, 180, 182, 183, 185, 187 to receive inputs from each of the sensors 174, 176, 180, 182, 183, 185, 187 as shown in FIG. 4. In particular, the sensors 174, 176, 180, 182, 183, 185, 187 may include an ice level sensor 174, a reservoir sensor 176, temperature sensors 183, 185, a pressure sensor 180, a filter port sensor 182, and a sensor 187 to detect the presence of the ice storage bin 54 in the ice maker receiving space 52. The ice level sensor 174 is coupled to the controller 170 via a signal line and is configured to detect if the ice storage bin 54 is full. The reservoir sensor 176 is coupled to the controller 170 via a signal line and is configured to detect if the cold water reservoir 132 is full or the water level in the cold water reservoir 132. In the illustrative embodiment, water discharged through the dispenser 120 after being heated in the heating assembly 130 may be between 175-185° F., and may be typically be about 180° F. In other embodiments, water discharged through the dispenser 120 after being heated in the heating assembly 130 may be hotter or cooler. The pressure sensor 180 is coupled to the controller 170 via a signal line and is configured to detect back pressure applied to the heating assembly 130 through the hot water valve 162. In some embodiments, the hot water valve 162 may be configured to regulate the pressure being supplied to the heater assembly 130. The filter port sensor 182 is coupled to the controller 170 via a signal line and is configured to detect the presence of the water filter cartridge 140 or the descaling cartridge 124. The temperature sensors 183, 185 are coupled to the controller 170 via signal lines and are configured to monitor the temperature of water entering and exiting the heating assembly 130. If the temperature difference between the sensors 183, 185 across the heating assembly 130 is determined by the controller 170 to be outside a predetermined range, the controller 170 may disable the heating assembly 130.

Sensor 187 is coupled to the controller 170 via a signal line and is configured to detect the presence or absence of a magnet 189. The presence of the magnet 189 is indicative that the ice storage bin 54 is properly positioned in the ice maker receiving space 52 to receive ice produced by the ice maker 20. The absence of the magnet 189 is indicative that the ice storage bin 54 is not positioned, or is not properly positioned, in the ice maker receiving space 52 to receive ice produced by the ice maker 20. The sensor 187 may communicate the presence or absence of the magnet 189 to the controller 170. The controller 170 may be programmed to, in response to the sensor 187 detecting the presence of the magnet 189, initiate or allow the production of ice via the ice maker 20. The controller 170 may also be programmed to, in response to the sensor 187 detecting the absence of the magnet 189 (e.g., the sensor 187 not detecting the magnet 189), prevent the ice maker 20 from the producing of ice. The sensor 187 may be a reed switch that is configured to close a circuit when the magnetic field of the magnet 189 is detected and to open the circuit when no magnetic field is detected, or vice versa.

Additionally, the controller 170 is electrically coupled to the electrically controlled valves 162, 164, 166, 168 and the heating assembly 130 as shown in FIG. 4. Specifically, the cold water valve 164 is coupled to the controller 170 via a signal line so that the controller 170 can direct the cold water valve 164 to open or close. The hot water valve 162 is coupled to the controller 170 via a signal line so that the controller 170 can direct the hot water valve 162 to open or close. The ice maker valve 168 is coupled to the controller 170 via a signal line so that the controller 170 can direct the ice maker valve 168 to open or close. The cold water dispenser valve 166 is coupled to the controller 170 via a signal line so that the controller 170 can direct the cold water dispense valve 166 to open or close. The heating assembly 130 is coupled to the controller 170 via a signal line so that the controller 170 can direct the heating assembly 130 to activate or deactivate the flow-through heating element 131.

Hence, the control system 128 including the controller 170 may be operated to control operation of the refrigerator 10. In particular, the controller 170 executes a routine including, among other things, a control scheme in which the controller 170 monitors outputs of the sensors 180, 185 in order to inform a user of detected scale build-up and to control the availability of hot water when water system 126 contains built up scale. To do so, the controller 170 communicates with the sensors 180, 185 in order to determine, among other things, if the water system 126, (and more particularly, if the components of the hot water line 135 that conducts water for the hot water function) is likely to contain a predetermined amount of scale build-up as indicated by an elevated temperature or pressure of water flowing through the dispenser 120. In some embodiments, the controller may communicate with both temperature sensors 183, 185 and compare the temperature rise across the heating assembly 130 to determine scale build up. Armed with this data, the controller 170 determines if a descaling cycle is desirable and if continued operation of the hot water function is allowable. Once it is determined if a descaling cycle is found to be desirable, the controller 170 can direct the user interface 172 to display a request for a user to initiate the descaling cycle. If the controller 170 determines that the continued operation of the hot water function is not allowable, the controller 170 can disable the water system 126 from providing hot water to the dispenser 120.

Referring to FIGS. 5-9, a valve system 200 for the water system 126 is illustrated in further detail. The valve system 200 may also be referred to as the water valve system. The valve system 200 may include one or more of the valves 202 (e.g., main valve 136, hot water valve 162, cold water valve 164, cold water dispenser valve 166, or ice maker valve 168) of the water system 126. Valves 202 are not shown in FIGS. 6 and 9 for illustrative purposes. The valve system 200 includes a bracket 204 that is configured to secure one or more valves 202 to the refrigerator 10. More specifically, the bracket 204 may be secured to a first of a plurality of internal walls (e.g., a first of the walls 13) within the fresh food compartment 12 while the valves 202 are secured to the bracket 204. The bracket 204 may more specifically be secured to a rear wall within the fresh food compartment 12. The bracket 204 may include a base plate 206. Locating and fastening features 208 may protrude from a forward-facing surface 210 of the bracket 204. More specifically, the forward-facing surface 210, may be a forward-facing surface of the base plate 206. A false wall 212 disposed within the fresh food compartment 12 and over the valve system 200 such that the valve system 200 is concealed within the fresh food compartment 12 and is disposed between the first of the internal walls (e.g., a first of the walls 13) and the false wall 212.

Figure 7:
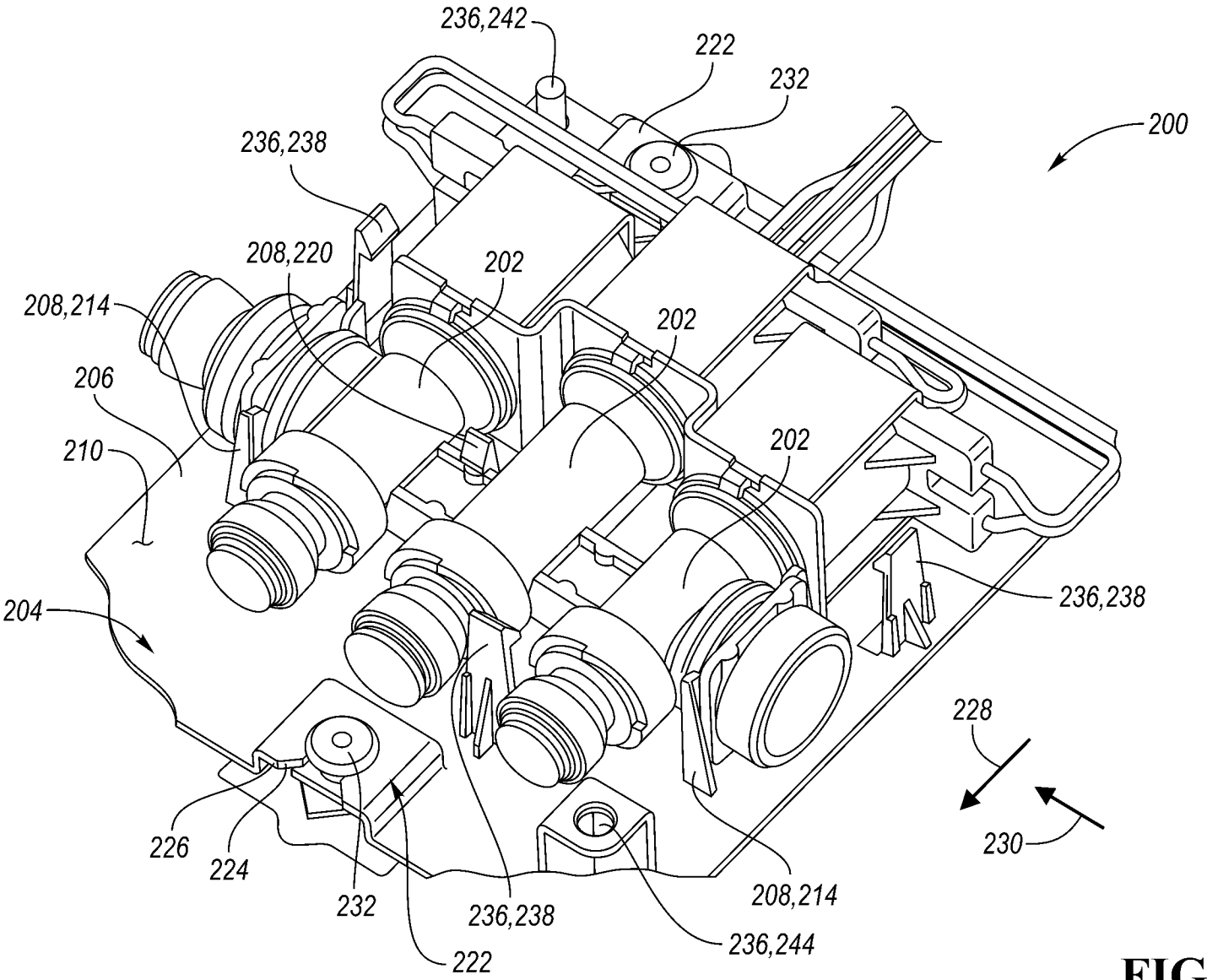
FIG. 7 is a perspective view of the water valve system including the bracket and a first valve configuration.
Figure 8:
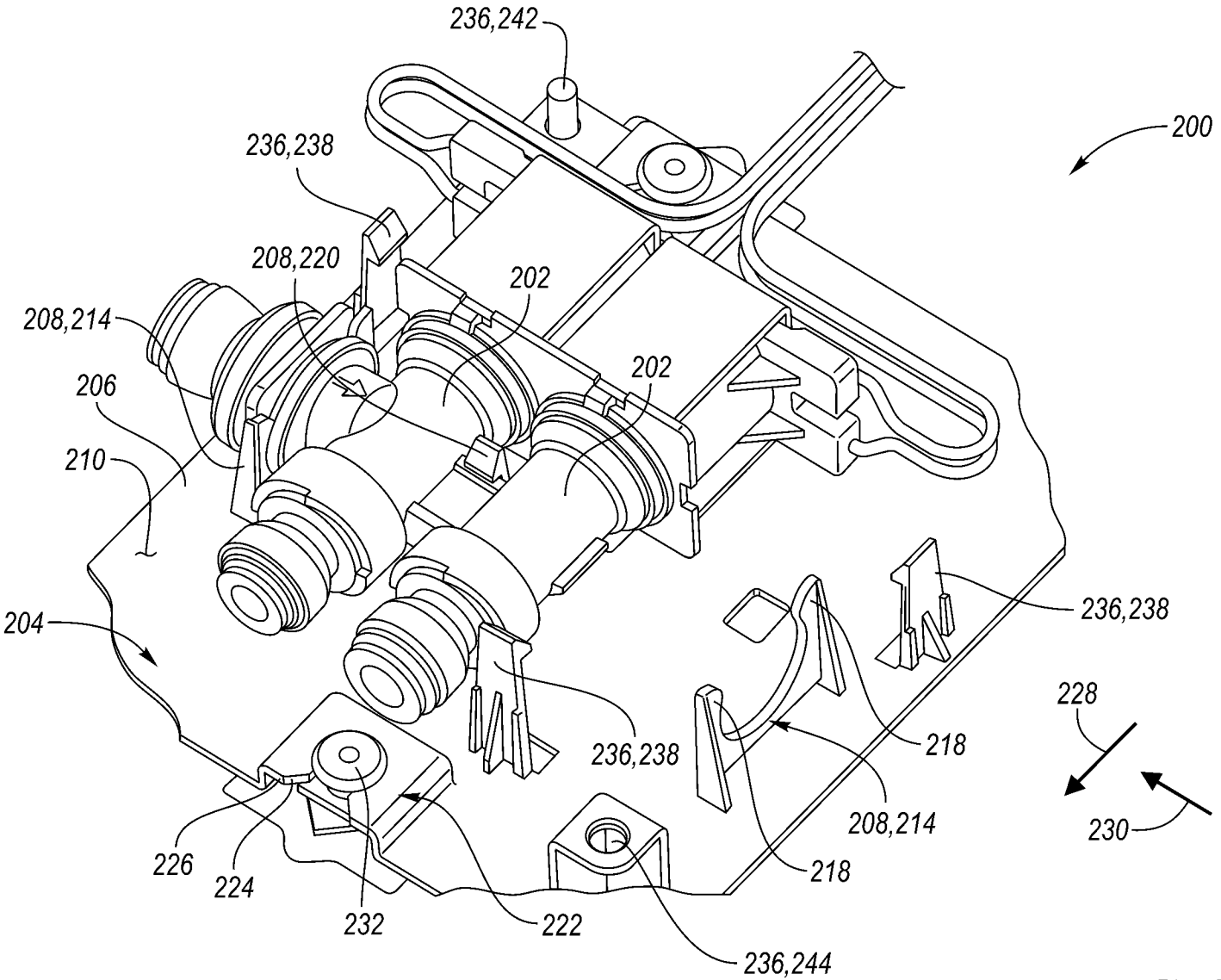
FIG. 8 is a perspective view of the water valve system including the bracket and a second valve configuration.
Figure 9:
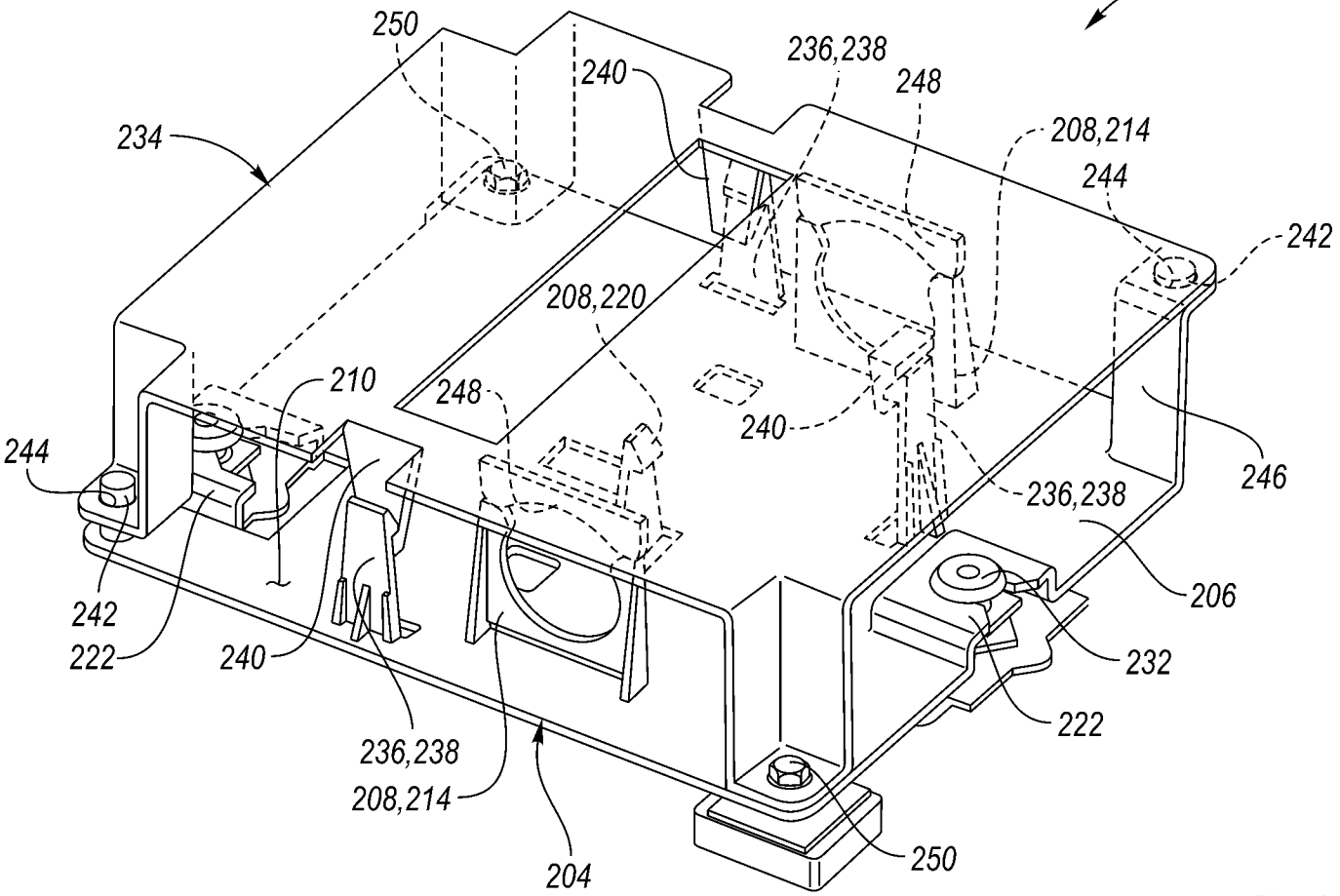
FIG. 9 is a perspective view of the bracket and a corresponding valve cover.

The locating and fastening features 208 are configured to locate and secure the valves 202 on and to the bracket 204 in a plurality of configurations (e.g., the valve configuration in FIG. 7 includes three valves 202 while the valve configuration in FIG. 8 includes two valves 202). A first set of the one or more valves 202 is arranged in a first of the plurality of configurations and engages at least a portion of the locating and fastening features 208 to locate and secure the first set of the one or more valves 202 on and to the bracket 204. The first set of the one or more valves 202 or a second set of set of the one or more valves 202, which is arranged in a second of the plurality of configurations, is configured to engage all of the locating and fastening features 208 (e.g., FIG. 7), while the other of the first and the second set of the one or more valves 202 is configured to engage a portion of the locating and fastening features 208 (e.g., FIG. 8).

One or more of the locating and fastening features 208 may be cradles 214 that protrude from the forward-facing surface 210 of the bracket 204. The cradles 214 may be configured to engage rounded or circular-shaped surfaces along the exterior of the configuration of valves 202 that is secured to the bracket 204. Outer ends of the cradles 214 may be clips or snaps 218 that flex outward during installation of valves 202 and snap back upon completing installation of the valves 202 to retain the valves 202 on the bracket 204. One or more of the locating and fastening features 208 may be snaps, J-hooks, or clips 220 that protrude from the forward-facing surface 210 of the bracket 204. The clips 220 may be configured to engage flat surfaces along the exterior of the configuration of valves 202 that is secured to the bracket 204.

The bracket 204 may include first and second protruding regions 222 that extend outward from the forward-facing surface 210 of the bracket 204 along opposing sides, edges, or ends of the bracket 204. More specifically, the opposing sides, edges, or ends may be opposing sides, edges, or ends of the base plate 206. The protruding regions 222 define first and second notches 224, respectively. The notches 224 having open ends 226 facing along a common direction 228. The first and second protruding regions are offset relative to each other in a direction 230 that is transverse to the common direction 228. Direction 230 may be substantially perpendicular to the common direction 228. Substantially perpendicular may refer to any incremental angle this is between exactly perpendicular and 15° from exactly perpendicular. The protruding regions 222 are configured to engage protrusions or locators 232 on the refrigerator 10 to position the bracket 204 and valve system 200 in desired orientations relative to the refrigerator 10 and to prevent the bracket 204 and valve system 200 from being positioned in orientations other than the desired orientations relative to the refrigerator 10.

More specifically, the protrusions or locators 232 may be heads of fasteners (e.g., quarter turn fasteners) where the fasteners are secured to the first of the internal walls (e.g., a first of the walls 13) and the protrusions or locators 232 are disposed within the notches 224 to position the bracket 204 and valve system 200 in desired orientations relative to the first of the internal walls and to prevent the bracket 204 and valve system 200 from being positioned in orientations other than the desired orientations relative to the first of the internal walls. More specifically, the offsetting between the two protruding regions 222 operates to prevent the bracket 204 from being positioned in orientations other than the desired orientations relative to the refrigerator 10 and/or first of the internal walls. Utilizing such features (e.g., the offset protruding regions 222 that engage the locators 232) to restrict installation of a component to a desired position or orientation relative to other components while simultaneously preventing the component from being installed in other non-desired positions or orientations is a concept known as the poka yoke concept.

The valve system 200 further includes a cover 234 that is secured to the bracket 204 and over the valves 202 that are secured to the bracket 204 such that the cover 234 is disposed between the bracket 204 and the false wall 212. The cover 234 is not shown in FIG. 6-8 for illustrative purposes. The bracket 204 may include secondary locating and fastening features 236 that are configured to locate and secure the cover 234 on and to the bracket 204. The secondary locating and fastening features 236 are configured to position the cover 234 in a desired orientation relative to the bracket 204 and prevent the cover 234 from being positioned in orientations other than the desired orientation relative to the bracket 204 according to the poka yoke concept.

Some of the secondary locating and fastening features 236 may be snaps, J-hooks, or clips 238 that protrude from the forward-facing surface 210 of the bracket 204, where the clips 238 engage tabs 240 on the cover 234 to secure the cover 234 to the bracket 204. The clips 238 may be oriented in different directions relative to each other, which operates to prevent the cover 234 from being positioned in orientations other than the desired orientation relative to the bracket 204 according to the poka yoke concept. For example, a first and a second of the clips 238 may be oriented at a substantially 180° angle relative to each other, while a third of the clips 238 is oriented substantially perpendicular to the first and second of the clips 238. Substantially 180° may refer to any incremental angle this is between exactly 180° and 15° from exactly 180°. Substantially perpendicular may refer to any incremental angle this is between exactly perpendicular and 15° from exactly perpendicular.

Some of the secondary locating and fastening features 236 may include locating pins 242 that engage receiving orifices 244 to position the cover 234 in the desired orientation relative to the bracket 204 and prevent the cover 234 from being positioned in orientations other than the desired orientation relative to the bracket 204 according to the poka yoke concept. The bracket 204 may include one or more locating pins 242 that engage receiving orifices 244 defined by the cover 234 and/or may include one or more receiving orifices 244 that engage locating pins 242 protruding from the cover 234. A first locating pin 242 and receiving orifice 244 engagement may positioned at a first distance from forward-facing surface 210 of the base plate 206 while a second locating pin 242 and receiving orifice 244 engagement may positioned at a second distance from forward-facing surface 210 that is not equal to the first distance. For example, the receiving orifice 244 that is defined by the bracket 204 is elevated from the forward-facing surface 210 by a stanchion 246 while the locating pin 242 that is secured to the bracket extends directly from the forward-facing surface 210. This staggered engagement between the first and second locating pin 242 and receiving orifice 244 engagements relative to the forward-facing surface 210 operates to further prevent the cover 234 from being positioned in orientations other than the desired orientation relative to the bracket 204 according to the poka yoke concept.

The cover 234 may also include opposing cradles 248 that are disposed opposite of the cradles 214. The opposing cradles 248 may also be configured to engage the rounded or circular-shaped surfaces along the exterior of the configuration of valves 202 that is secured to the bracket 204 opposite of the cradles 214. The opposing cradles 248 may also operate to retain the valve 202 on the bracket 204. Fasteners 250 may extend through aligned orifices defined by the bracket 204 and cover 234 to both (i) secure the cover 234 to the bracket 204 and collectively secure the bracket 204 and cover 234 to the refrigerator 10, or more specifically to the first of the internal walls (e.g., a first of the walls 13).

Figure 5:
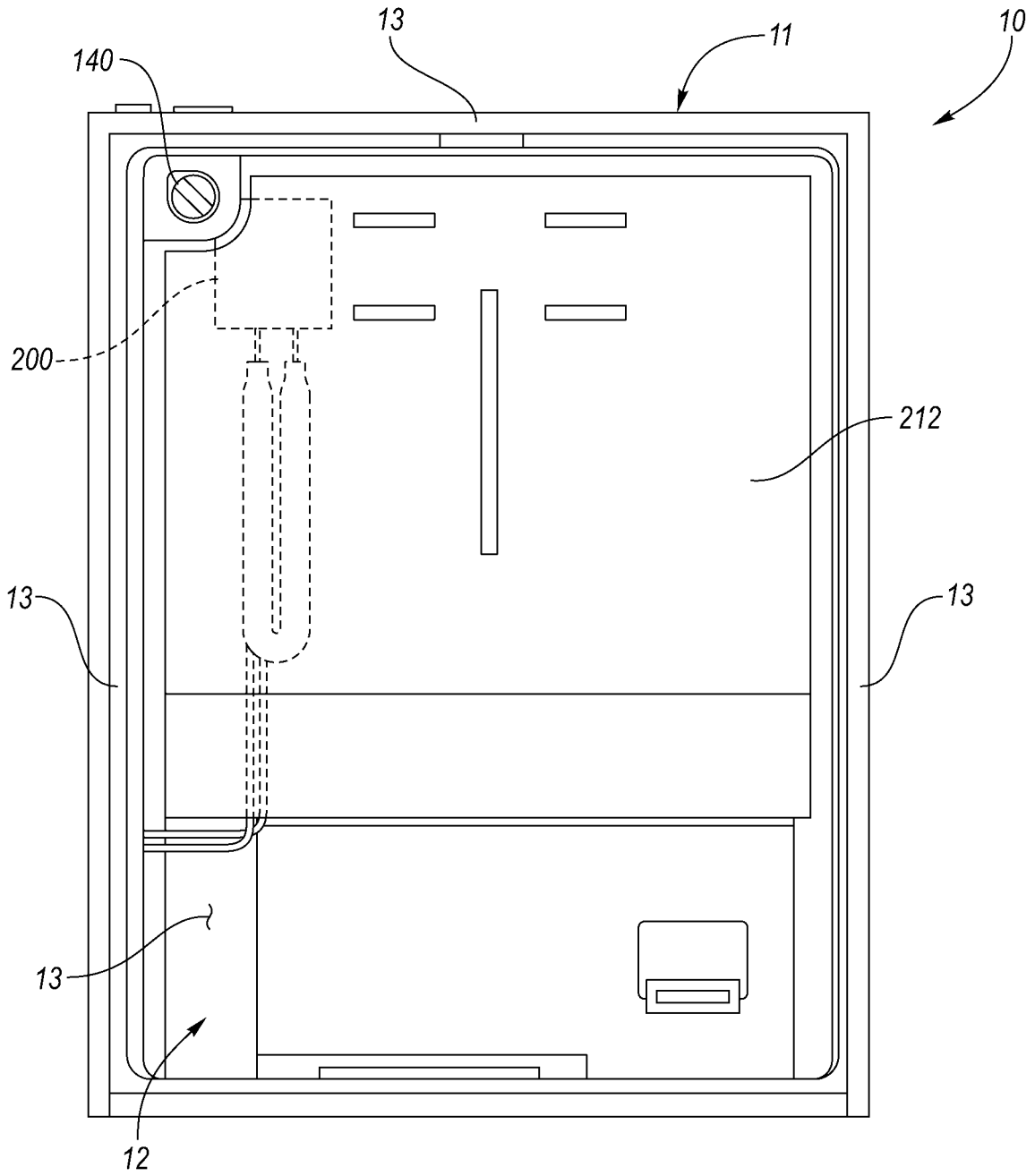
FIG. 5 is a front view of the refrigerator with the refrigerator compartment doors removed.
Figure 6:
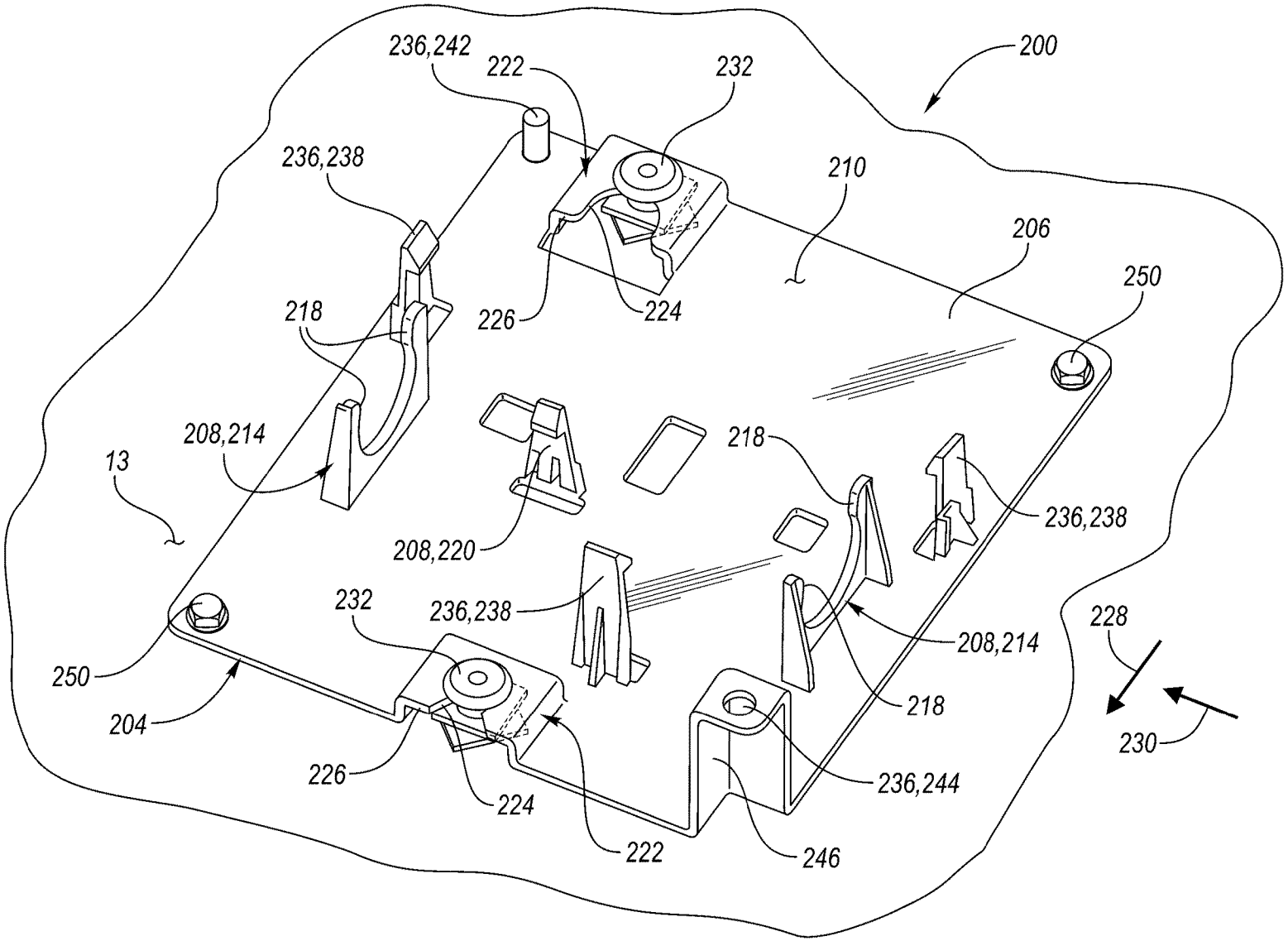
FIG. 6 is a perspective view of a bracket for a water valve system.
Figure 10:
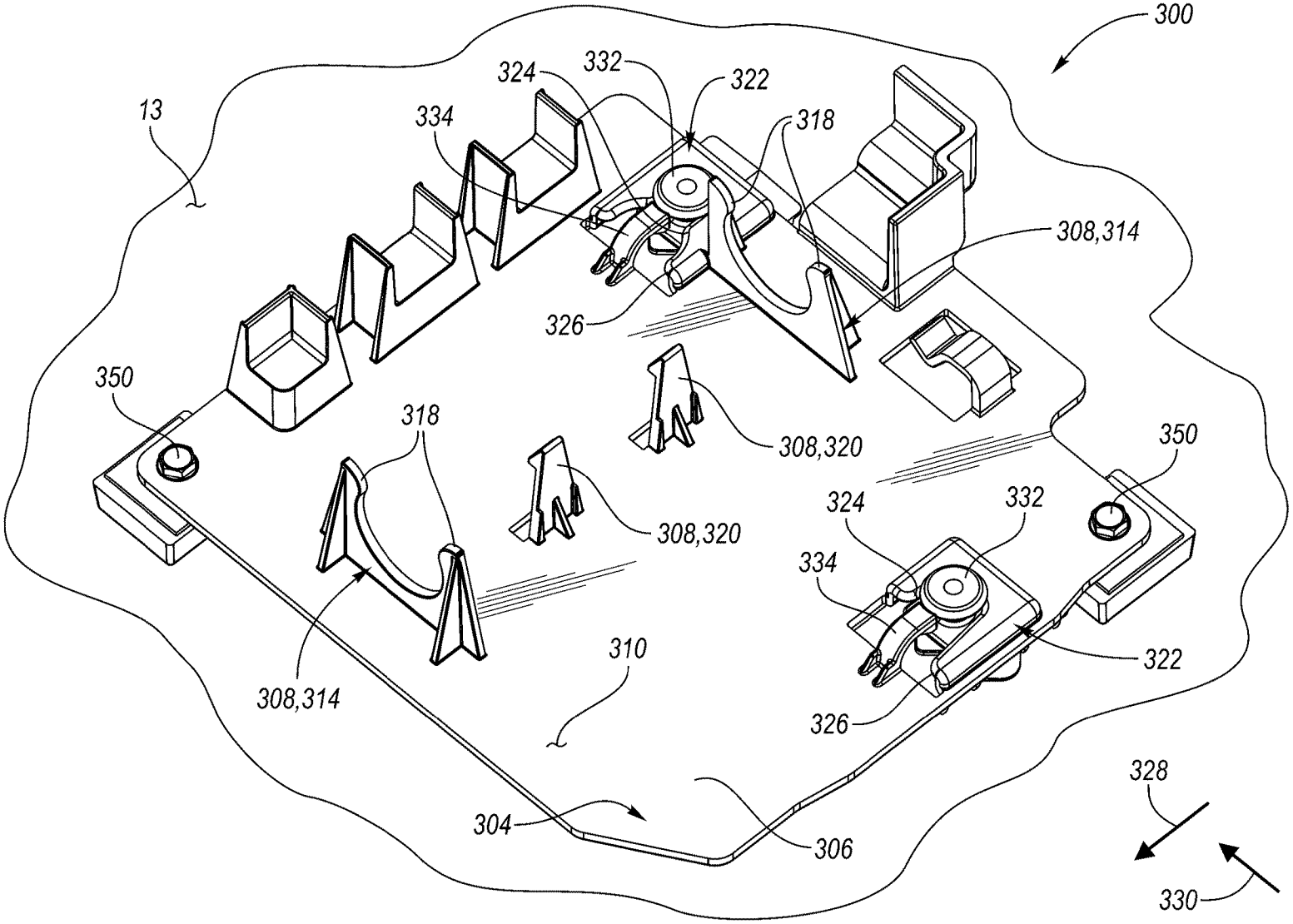
FIG. 10 is a perspective view of a second embodiment of a bracket for a second embodiment of the water valve system.
Figure 11:
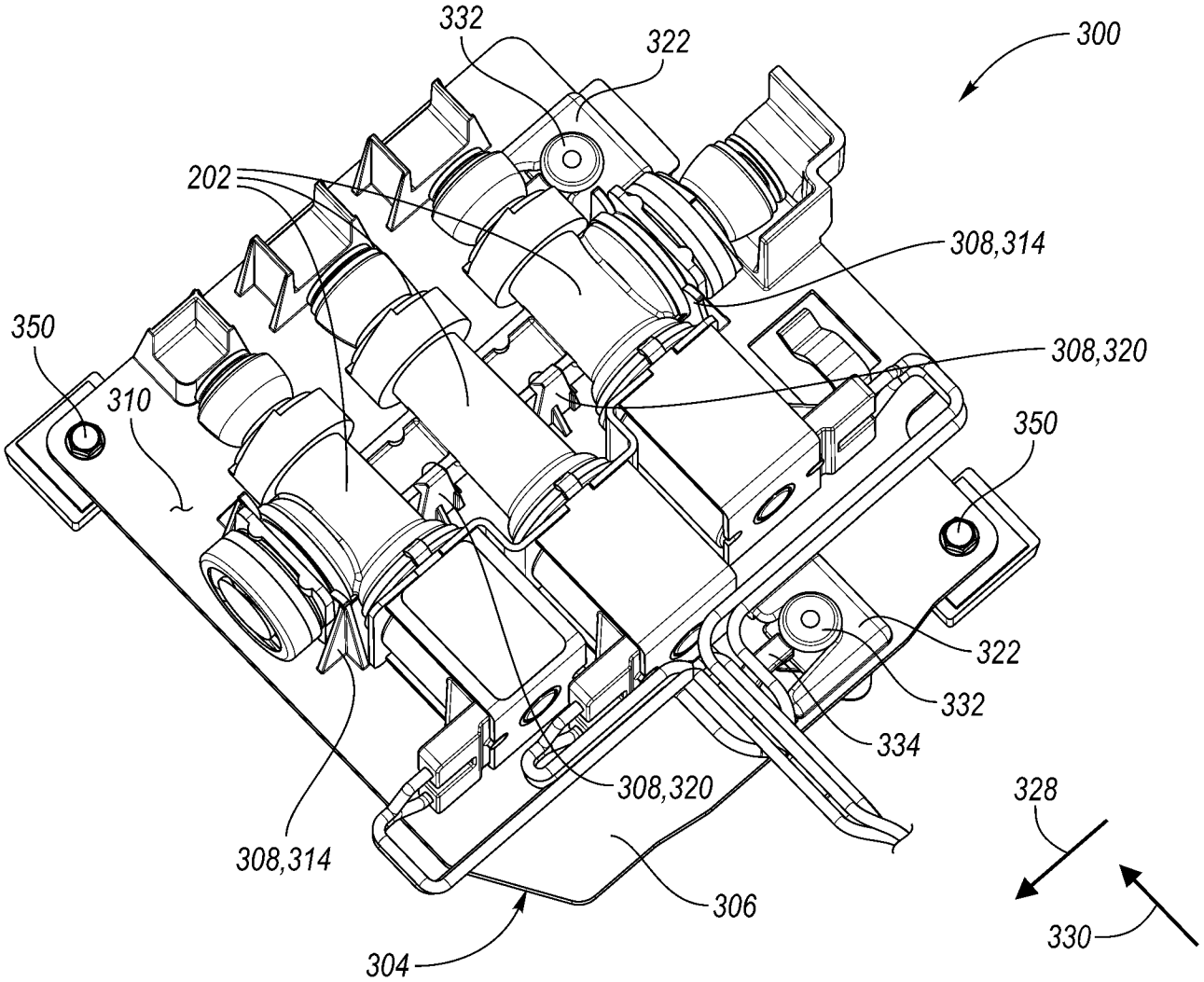
FIG. 11 is a perspective view of the second embodiment of the water valve system including the second embodiment of the bracket and the first valve configuration.
Figure 12:
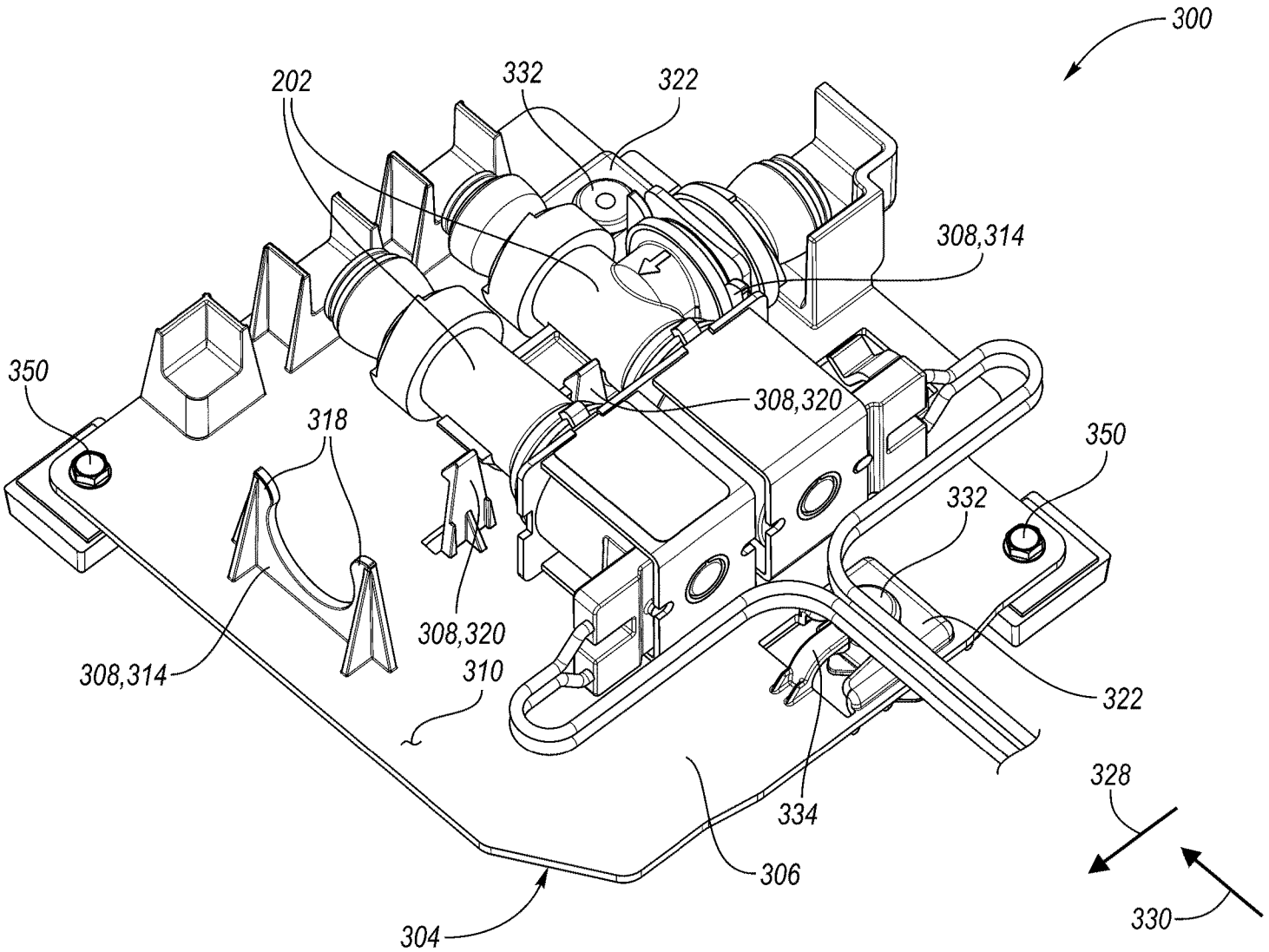
FIG. 12 is a perspective view of the second embodiment of the water valve system including the second embodiment of the bracket and the second valve configuration.

Referring to FIGS. 10-12, a second embodiment of a valve system 300 for the water system 126 is illustrated in further detail. The valve system 300 should be construed to include all of the elements, characteristics, and functionally of valve system 200 unless otherwise stated herein. Valve system 300 may be utilized in lieu of valve system 200 and may be positioned within the refrigerator 10 in the same manner as valve system 200, which is illustrated in FIG. 5.

The valve system 300 may also be referred to as the water valve system. The valve system 300 may include the one or more of the valves 202 (e.g., main valve 136, hot water valve 162, cold water valve 164, cold water dispenser valve 166, or ice maker valve 168) of the water system 126. Valves 202 are not shown in FIG. 10 for illustrative purposes. The valve system 300 includes a bracket 304 that is configured to secure one or more valves 202 to the refrigerator 10. More specifically, the bracket 304 may be secured to a first of a plurality of internal walls (e.g., a first of the walls 13) within the fresh food compartment 12 while the valves 202 are secured to the bracket 304. The bracket 304 may more specifically be secured to a rear wall within the fresh food compartment 12. The bracket 304 may include a base plate 306. Locating and fastening features 308 may protrude from a forward-facing surface 310 of the bracket 304. More specifically, the forward-facing surface 310, may be a forward-facing surface of the base plate 306. The false wall 212 may be disposed within the fresh food compartment 12 and over the valve system 300 such that the valve system 300 is concealed within the fresh food compartment 12 and is disposed between the first of the internal walls (e.g., a first of the walls 13) and the false wall 212.

The locating and fastening features 308 are configured to locate and secure the valves 202 on and to the bracket 304 in a plurality of configurations (e.g., the valve configuration in FIG. 11 includes three valves 202 while the valve configuration in FIG. 12 includes two valves 202). A first set of the one or more valves 202 is arranged in a first of the plurality of configurations and engages at least a portion of the locating and fastening features 308 to locate and secure the first set of the one or more valves 202 on and to the bracket 304. The first set of the one or more valves 202 or a second set of set of the one or more valves 202, which is arranged in a second of the plurality of configurations, is configured to engage all of the locating and fastening features 308 (e.g., FIG. 11), while the other of the first and the second set of the one or more valves 202 is configured to engage a portion of the locating and fastening features 308 (e.g., FIG. 12).

One or more of the locating and fastening features 308 may be cradles 314 that protrude from the forward-facing surface 310 of the bracket 304. The cradles 314 may be configured to engage rounded or circular-shaped surfaces along the exterior of the configuration of valves 202 that is secured to the bracket 304. Outer ends of the cradles 314 may be clips or snaps 318 that flex outward during installation of valves 202 and snap back upon completing installation of the valves 202 to retain the valves 202 on the bracket 304. One or more of the locating and fastening features 308 may be snaps, J-hooks, or clips 320 that protrude from the forward-facing surface 310 of the bracket 304. The clips 320 may be configured to engage flat surfaces along the exterior of the configuration of valves 202 that is secured to the bracket 304.

The bracket 304 may include first and second protruding regions 322 that extend outward from the forward-facing surface 310 of the bracket 304 along opposing sides, edges, or ends of the bracket 304. More specifically, the opposing sides, edges, or ends may be opposing sides, edges, or ends of the base plate 306. The protruding regions 322 define first and second notches 324, respectively. The notches 324 having open ends 326 facing along a common direction 328. The first and second protruding regions are offset relative to each other in a direction 330 that is transverse to the common direction 328. Direction 330 may be substantially perpendicular to the common direction 328. Substantially perpendicular may refer to any incremental angle this is between exactly perpendicular and 15° from exactly perpendicular. The protruding regions 322 are configured to engage protrusions or locators 332 on the refrigerator 10 to position the bracket 304 and valve system 300 in desired orientations relative to the refrigerator 10 and to prevent the bracket 304 and valve system 300 from being positioned in orientations other than the desired orientations relative to the refrigerator 10.

Snaps, J-hooks, or clips 334 may extend upward from the forward-facing surface 310 of the bracket 304 over at least a portion of the notches 324. The snaps, J-hooks, or clips 334 are configured to engage the protrusions or locators 332 and flex outward from relaxed or static positions relative to the forward-facing surface 310 (e.g., away from the forward-facing surface 310) during installation of the bracket 304 onto the protrusions or locators 332. Once the protrusions or locators 332 are positioned completely within the notches 324, the snaps, J-hooks, or clips 334 are configured to snap back into the relaxed or static positions trapping the protrusions or locators 332 within the notches 324. More specifically, installation of the bracket 304 onto the protrusions or locators 332 may include sliding the bracket 304 onto the protrusions or locators 332 along the common direction 328 and the snaps, J-hooks, or clips 334 may prevent the bracket 304 from disengaging the protrusions or locators 332 in a direction opposite to the common direction 328 once the protrusions or locators 332 are positioned completely within the notches 324.

More specifically, the protrusions or locators 332 may be heads of fasteners (e.g., quarter turn fasteners) where the fasteners are secured to the first of the internal walls (e.g., a first of the walls 13) and the protrusions or locators 332 are disposed within the notches 324 to position the bracket 304 and valve system 300 in desired orientations relative to the first of the internal walls and to prevent the bracket 304 and valve system 300 from being positioned in orientations other than the desired orientations relative to the first of the internal walls. More specifically, the offsetting between the two protruding regions 322 operates to prevent the bracket 304 from being positioned in orientations other than the desired orientations relative to the refrigerator 10 and/or first of the internal walls according to the poka yoke concept.

Fasteners 350 may extend through orifices defined by the bracket 304 to secure the bracket 304 to the refrigerator 10, or more specifically to the first of the internal walls (e.g., a first of the walls 13).

The valve systems 200, 300 described herein provide the benefit of allowing a common bracket to be utilized for several valve configurations, which decreases tooling costs, manufacturing cost, etc. The valve systems 200, 300 described herein also provide the benefit of ensuring proper installation of the valve systems 200, 300 via leveraging the poka yoke concept.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet having a plurality of internal walls defining a refrigerated space;

a valve system having, a bracket (i) secured to a first of the internal walls and (ii) having locating and fastening features configured to locate and secure a plurality of valve configurations on and to the bracket, and a first of the plurality of valve configurations engaging at least a portion of the locating and fastening features to locate and secure the first of the plurality of valve configurations on and to the bracket; and a false wall disposed within the refrigerated space and over the valve system such that the valve system is (i) concealed within the refrigerated space and (ii) disposed between the first of the internal walls and the false wall.

2. The refrigerator of claim 1, wherein (i) one of the first and a second of the plurality of valve configurations is configured to engage all of the locating and fastening features and (ii) the other of the first and the second of the plurality of valve configurations is configured to engage the portion of the locating and fastening features.

3. The refrigerator of claim 1, wherein one or more of the locating and fastening features are cradles that protrude from a forward-facing surface of the bracket.

4. The refrigerator of claim 3, wherein outer ends of the cradles are snaps that flex outward during installation of the plurality of valve configurations and snap back upon completing installation of the plurality of valve configurations to retain the plurality of valve configurations.

5. The refrigerator of claim 1, wherein one or more of the locating and fastening features are snaps or clips that protrude from a forward-facing surface of the bracket.

6. The refrigerator of claim 1, wherein the bracket defines first and second notches along opposing sides to the bracket, and wherein the first and second notches (i) each have open ends facing a common direction, (ii) are offset relative to each other in a direction that is transverse to the common direction, and (iii) are configured to engage protrusions extending from the first of the internal walls to (a) position the valve system in a desired orientation relative to the first of the internal walls and (b) prevent the valve system from being positioned in orientations other than the desired orientation relative to the first of the internal walls.

7. The refrigerator of claim 1 further comprising a cover secured to the bracket and over the first of the plurality of valve configurations such that the cover is disposed between the bracket and the false wall.

8. The refrigerator of claim 7, wherein the bracket includes secondary locating and fastening features configured to locate and secure the cover on and to the bracket, wherein the secondary locating and fastening features are configured to (i) position the cover in a desired orientation relative to the bracket and (ii) prevent the cover from being positioned in orientations other than the desired orientation relative to the bracket.

9. A water valve system for a refrigerator appliance comprising:

a bracket (i) configured to secure one or more valves to the refrigerator and (ii) having locating and fastening features configured to locate and secure the one or more valves on and to the bracket in a plurality of configurations; and a first set of the one or more valves (i) arranged in a first of the plurality of configurations and (ii) engaging at least a portion of the locating and fastening features to locate and secure the first set of the one or more valves on and to the bracket.

10. The water valve system of claim 9, wherein (i) one of the first set and a second set of the one or more valves is configured to engage all of the locating and fastening features and (ii) the other of the first set and the second set of the one or more valves is configured to engage the portion of the locating and fastening features.

11. The water valve system of claim 9, wherein one or more of the locating and fastening features are cradles that protrude from a forward-facing surface of the bracket.

12. The water valve system of claim 11, wherein outer ends of the cradles are snaps that flex outward during installation of the one or more valves and snap back upon completing installation of the one or more valves to retain the one or more valves.

13. The water valve system of claim 9, wherein one or more of the locating and fastening features are snaps or clips that protrude from a forward-facing surface of the bracket.

14. The water valve system of claim 9, wherein the bracket defines first and second notches along opposing sides to the bracket, and wherein the first and second notches (i) each have open ends facing a common direction, (ii) are offset relative to each other in a direction that is transverse to the common direction, and (iii) are configured to engage protrusions extending from the refrigerator to (a) position the water valve system in a desired orientation relative to the refrigerator and (b) prevent the water valve system from being positioned in orientations other than the desired orientation relative to the refrigerator.

15. The water valve system of claim 9 further comprising a cover secured to the bracket and over the first set of the one or more valves.

16. The water valve system of claim 15, wherein the bracket includes secondary locating and fastening features configured to locate and secure the cover on and to the bracket, wherein the secondary locating and fastening features are configured to (i) to position the cover in a desired orientation relative to the bracket and (ii) prevent the cover from being positioned in orientations other than the desired orientation relative to the bracket.

17. A bracket configured to secure one or more valves to a refrigerator comprising:

a base plate;

locating and fastening features (i) protruding from a forward-facing surface of the bracket and (ii) configured to locate and secure valves on and to the bracket in a plurality of configurations; and first and second protruding regions (i) extending outward from the forward-facing surface and (ii) defining first and second notches, respectively, having open ends facing a common direction, wherein the first and second protruding regions (a) are offset relative to each other in a direction that is transverse to the common direction and (b) the first and second protruding regions are configured to engage locators on the refrigerator to (I) position the bracket in a desired orientation relative to the refrigerator and (II) prevent the bracket from being positioned in orientations other than the desired orientation relative to the refrigerator.

18. The bracket of claim 17, wherein one or more of the locating and fastening features are cradles that protrude from the forward-facing surface of the bracket.

19. The bracket of claim 18, wherein outer ends of the cradles are snaps that flex outward during installation of the one or more valves and snap back upon completing installation of the one or more valves to retain the one or more valves.

20. The bracket of claim 17, wherein one or more of the locating and fastening features are snaps or clips that protrude from the forward-facing surface of the bracket.

* * * * *